US007977024B2

(12) United States Patent
Zhou et al.

(10) Patent No.: US 7,977,024 B2
(45) Date of Patent: Jul. 12, 2011

(54) SOLVENT-FREE TONER MAKING PROCESS USING PHASE INVERSION

(75) Inventors: Ke Zhou, Mississauga (CA); Guerino G. Sacripante, Oakville (CA); Edward G. Zwartz, Mississauga (CA)

(73) Assignee: Xerox Corporation, Norwalk, CT (US)

( * ) Notice: Subject to any disclaimer, the term of this patent is extended or adjusted under 35 U.S.C. 154(b) by 1157 days.

(21) Appl. No.: 11/305,419

(22) Filed: Dec. 16, 2005

(65) Prior Publication Data

US 2007/0141494 A1 Jun. 21, 2007

(51) Int. Cl.
*G03G 9/083* (2006.01)

(52) U.S. Cl. ..... 430/137.1; 430/109.2

(58) Field of Classification Search ..... 430/137.1, 430/137.19, 109.2, 108.5
See application file for complete search history.

(56) References Cited

U.S. PATENT DOCUMENTS

| | | | | |
|---|---|---|---|---|
| 4,123,403 | A * | 10/1978 | Warner et al. | 523/313 |
| 5,502,118 | A * | 3/1996 | Macholdt et al. | 525/437 |
| 5,714,292 | A * | 2/1998 | Anno et al. | 430/108.1 |
| 5,843,614 | A | 12/1998 | Shinzo et al. | |
| 5,885,743 | A | 3/1999 | Takayanagi et al. | |
| 6,150,062 | A * | 11/2000 | Sugizaki et al. | 430/45.55 |
| 6,521,679 | B1 * | 2/2003 | Okada et al. | 523/336 |
| 6,894,090 | B2 | 5/2005 | Shinzo et al. | |
| 2003/0124448 | A1 * | 7/2003 | Shinzo et al. | 430/109.4 |

OTHER PUBLICATIONS

Ke Zhou et al., U.S. Appl. No. 11/248,277, filed Oct. 13, 2005, titled "Emulsion Containing Epoxy Resin."

Zhengzhong Yang et al., "Preparation of Waterborne Ultrafine Particles of Epoxy Resin by Phase Inversion Technique," *Chinese Journal of Polymer Science*, vol. 15, No. 1, pp. 92-96 (1997).

Z. Z. Yang et al., "Preparation of waterborne dispersions of epoxy resin by the phase-inversion emulsification technique. 1. Experimental study on the phase-inversion process," *Colloid Polym. Sci.*, vol. 278, pp. 1164-1171 (2000).

Z. Z. Yang et al., "Preparation of waterborne dispersions of epoxy resin by the phase-inversion emulsification technique. 2. Theoretical consideration of the phase-inversion process," *Colloid Polym. Sci.*, vol. 278, pp. 1103-1108 (2000).

Kenichi Hibino et al., "Epoxy Resin Particles, 3, Particle Formation of Epoxy Resin in Aqueous Emulsion State," *Macromol. Mater. Eng.*, vol. 286, pp. 325-329 (2001).

* cited by examiner

*Primary Examiner* — Janis L Dote
(74) *Attorney, Agent, or Firm* — Fay Sharpe LLP; Zosan S. Soong

(57) ABSTRACT

A process for making toner particles comprising: (a) forming an emulsion comprising a disperse phase including a first aqueous composition and a continuous phase including molten one or more ingredients of a toner composition, wherein there is absent a toner resin solvent in the continuous phase; (b) performing a phase inversion to create a phase inversed emulsion comprising a disperse phase including toner-sized droplets comprising the molten one or more ingredients of the toner composition and a continuous phase including a second aqueous composition; and (c) solidifying the toner-sized droplets to result in toner particles.

10 Claims, No Drawings

SOLVENT-FREE TONER MAKING PROCESS USING PHASE INVERSION

BACKGROUND OF THE INVENTION

There is a need addressed by embodiments of the present invention for new chemical toner making processes which reduce the number of stages and materials. Such processes are advantageous for reducing production costs.

The following documents provide background information:

Ke Zhou et al., U.S. application Ser. No. 11/248,277, filed Oct. 13, 2005, titled "Emulsion Containing Epoxy Resin."

Shinzo et al., U.S. Pat. No. 6,894,090 B2.

Takayanagi et al., U.S. Pat. No. 5,885,743.

Shinzo et al., U.S. Pat. No. 5,843,614.

Zhengzhong Yang et al., "Preparation of Waterborne Ultrafine Particles of Epoxy Resin by Phase Inversion Technique," *Chinese Journal of Polymer Science*, Vol. 15, No. 1, pp. 92-96 (1997).

Z. Z. Yang et al., "Preparation of waterborne dispersions of epoxy resin by the phase-inversion emulsification technique. 1. Experimental study on the phase-inversion process," *Colloid Polym. Sci*., Vol. 278, pp. 1164-1171 (2000).

Z. Z. Yang et al., "Preparation of waterborne dispersions of epoxy resin by the phase-inversion emulsification technique. 2. Theoretical consideration of the phase-inversion process," *Colloid Polym. Sci*., Vol. 278, pp. 1103-1108 (2000).

Kenichi Hibino et al., "Epoxy Resin Particles, 3, Particle Formation of Epoxy Resin in Aqueous Emulsion State," *Macromol. Mater. Eng*., Vol. 286, pp. 325-329 (2001).

SUMMARY OF THE DISCLOSURE

There is provided in embodiments a process for making toner particles comprising:

forming an emulsion comprising a disperse phase including a first aqueous composition and a continuous phase including molten one or more ingredients of a toner composition, wherein there is absent a toner resin solvent in the continuous phase;

performing a phase inversion to create a phase inversed emulsion comprising a disperse phase including toner-sized droplets comprising the molten one or more ingredients of the toner composition and a continuous phase including a second aqueous composition; and solidifying the toner-sized droplets to result in toner particles.

There is further provided in embodiments a process for making toner particles comprising:

heating one or more ingredients of a toner composition to a molten state, wherein there is absent a toner resin solvent with the molten one or more ingredients of the toner composition;

adding an aqueous composition to the molten one or more ingredients of the toner composition to perform a phase inversion to create a phase inversed emulsion comprising a disperse phase including toner-sized droplets comprising the molten one or more ingredients of the toner composition and a continuous phase including the aqueous composition; and solidifying the toner-sized droplets to result in toner particles.

There is also provided in embodiments a phase inversed emulsion comprising: a disperse phase including toner-sized droplets comprising molten one or more ingredients of a toner composition and a continuous phase including an aqueous composition, wherein there is absent a toner resin solvent in the phase inversed emulsion.

There is provided in other embodiments toner particles prepared by a process comprising:

heating one or more ingredients of a toner composition to a molten state, wherein there is absent a toner resin solvent with the molten one or more ingredients of the toner composition;

adding an aqueous composition to the molten one or more ingredients of the toner composition to perform a phase inversion to create a phase inversed emulsion comprising a disperse phase including toner-sized droplets comprising the molten one or more ingredients of the toner composition and a continuous phase including the aqueous composition; and solidifying the toner-sized droplets to result in the toner particles.

DETAILED DESCRIPTION

The present process involves heating one or more ingredients of a toner composition to a molten state, wherein there is absent a toner resin solvent with the molten one or more ingredients of the toner composition. Then there is added an aqueous composition to the molten one or more ingredients of the toner composition, which forms an emulsion comprising a disperse phase including droplets of the aqueous composition and a continuous phase including the molten one or more ingredients of the toner composition. Phase inversion can be accomplished by for instance continuing to add the same or different aqueous composition to create a phase inversed emulsion comprising a disperse phase including toner-sized droplets comprising the molten one or more ingredients of the toner composition and a continuous phase including the aqueous composition. In embodiments, the toner resin is crosslinkable and the present process permits the phase inversed emulsion to be formed at temperatures avoiding premature crosslinking (also can be referred to as "curing") of the toner resin. Unless otherwise indicated, the term "emulsion" is used to differentiate the pre-phase inversion composition from the "phased inversed emulsion."

The disperse phase in the phase inversed emulsion comprises toner-sized droplets (the disperse phase in the emulsion comprises droplets which may or may not be toner-sized). "Toner-sized" indicates that the droplets have a size comparable to toner particles used in xerographic printers and copiers, wherein "toner sized" in embodiments indicates a volume average diameter ranging for example from about 3 to about 25 μm, from about 3 to about 12 μm or about 5 to about 10 μm. It is difficult to directly measure droplet size in the emulsion/phased inversed emulsion; so, for the present purposes, the droplet size in the emulsion/phased inversed emulsion is determined by solidifying the toner-sized droplets and then measuring the resulting toner particles.

Because the droplets are toner-sized in the disperse phase of the phase inversed emulsion, there is generally no need to aggregate the droplets to increase the size thereof prior to solidifying the droplets to result in the toner particles. However, such aggregation/coalescence of the droplets is optional and can be employed in embodiments of the present invention including the aggregation/coalescence techniques described in for example Ke Zhou et al., U.S. application Ser. No. 11/248,277, filed Oct. 13, 2005, titled "Emulsion Containing Epoxy Resin," the disclosure of which is totally incorporated herein by reference.

In embodiments, the present process comprises heating one or more ingredients of a toner composition to above about the glass transition temperature of the toner resin, stirring the toner composition, and, while maintaining the temperature at above about the glass transition temperature, metering water into the mixture to form an emulsion comprising a disperse phase including water and a continuous phase including a toner composition, and continuing to add water until phase inversion occurs to form the phase inversed emulsion.

In the above-mentioned heating, the heating to above about the glass transition temperature ("Tg") of the toner resin(s) may be from about 50° C. to about 120° C., for example from about 60° C. to about 105° C. or from about 70° C. to about 100° C. The heating need not be held at a constant temperature, but may be varied. For example, the heating may be slowly or incrementally increased during heating until a desired temperature is achieved. In embodiments, the present process includes heating the one or more ingredients of the toner composition to the molten state at a temperature ranging from about 25 to about 75 degrees C. above the Tg of the toner resin. In embodiments, the heating results in the molten one or more ingredients of the toner composition having a viscosity ranging from about 10 to about 10,000 poise.

Stirring may be achieved using any suitable stirring device. The stirring need not be at a constant speed, but may be varied. For example, as the heating of the mixture becomes more uniform, the stirring rate may be increased. In embodiments, the stirring may be at from about 10 rpm to about 2,000 rpm, for example from about 50 rpm to about 1,000 rpm or from about 100 rpm to about 600 rpm. Too vigorous an agitation may result in collapse of the emulsion/phase inversed emulsion. In embodiments, it is possible to use an homogenizer (that is, a high shear device), but in other embodiments, the present process avoids the use of such an homogenizer which operates for example at a rate ranging for instance from about 6,000 to about 10,000 rpm. In embodiments, the present process includes stirring at rate ranging from about 50 to about 200 rpm during the heating to the molten state, and stirring at a rate ranging from about 600 to about 1,000 rpm during the adding the aqueous composition to the molten one or more ingredients of the toner composition to perform the phase inversion.

While the temperature is maintained in the aforementioned range, water, for example deionized water, is then metered into the heated mixture at least until phase inversion is achieved. At phase inversion, the toner composition becomes emulsified and dispersed within the aqueous phase (that is, continuous phase). That is, an "oil-in-water" emulsion of the toner composition in the aqueous phase is formed. Phase inversion may be confirmed by, for example, measuring via any of the techniques described in, for example, Z. Yang et al., "Preparations of Waterborne Dispersions of Epoxy Resin by the Phase-Inversion Emulsification Technique," *Colloid Polym Sci.*, Vol. 278, pgs 1164-1171 (2000), which is totally incorporated herein by reference. Prior to addition, the aqueous composition may have any suitable temperature such as room temperature or an elevated temperature (e.g., above the toner resin Tg).

In embodiments, the water is metered in at a rate of about 0.01% to about 10% by weight of the emulsion every 10 minutes, for example from about 0.5% to about 5% by weight or from about 1% to about 4% by weight of the emulsion every 10 minutes. The rate of water addition need not be constant, but can be varied. Thus, for example for a 700 gram toner composition, the water may be added at a rate of about 1 gram to about 70 grams every 10 minutes, such as from about 2 to about 40 grams or from about 5 to about 25 grams, every 10 minutes. Although the point of phase inversion varies depending on the components of the emulsion, the temperature of heating, the stirring speed, etc., phase inversion may occur when water has been added to comprise from about 30% to about 70% by weight of the emulsion, for example from about 35% to about 65% or from about 40% to about 60% by weight of the emulsion.

Following phase inversion, additional water optionally may be added to dilute the phase inversed emulsion, although such is not required at this stage. This additional water may be added at a more rapid rate than the metered rate above.

In embodiments, the aqueous composition includes water as the sole type of liquid and the present process is described using water as the aqueous composition. Water is the preferred liquid for the disperse phase of the emulsion and the continuous phase of the phase inversed emulsion since water is environmentally friendly. However, in other embodiments, the aqueous composition comprises water and one or more other liquids such as for example alcohols (e.g., ethanol and isopropanol) and acetic acid. In embodiments, the one or more other liquids in the aqueous composition are for instance polar, do not dissolve the toner resin, and/or are miscible with water. The one or more other liquids may be in any suitable ratio with the water such as for instance 50% (water)/50% (other liquid(s)) by volume. The aqueous composition used to create the emulsion can be the same or different from the aqueous composition added to perform the phase inversion. The two aqueous compositions can vary for instance in the concentration and/or type(s) of the non-water liquid(s). The aqueous composition can be added in any suitable manner such as for instance the following embodiments: (1) after the one or more ingredients of the toner composition are in the molten state; and (2) prior to and during the time that the one or more ingredients of the toner composition are in the molten state.

Following phase inversion, the phase inversed emulsion may be cooled to room temperature, for example from about 20° C. to about 25° C. Such cooling of the phase inversed emulsion to room temperature is one way of solidifying the droplets containing the toner composition to result in toner particles. It is understood that the toner particles immediately resulting from solidifying the toner-sized droplets may or may not be suitable for immediate use in a xerographic printer or copier. The present process in embodiments may involve optional further processing such as for instance one or more of the following: washing, filtering, freeze drying, and addition of external additive(s). The term "toner particles" in the context of "solidifying the toner-sized droplets to result in toner particles" indicates for instance solidification of the toner-sized droplets and does not preclude optional further processing of the solidified toner-sized droplets.

In embodiments, a curable clear toner is prepared by an one step (that is, done in one pot or insitu), top-down process (that is, going from bulk toner ingredients to smaller toner-sized particles as opposed to starting with smaller particles and growing to toner sized particles) where toner particles can be prepared directly from toner ingredient(s) via phase inversion emulsification.

A solvent for the toner resin (that is, a "toner resin solvent") is not used in embodiments of the present process. The toner resin solvent is typically an organic solvent such as for example toluene, xylene, methyl ethyl ketone, and ethyl acetate.

The toner composition comprises a toner resin, optionally a colorant (the toner composition is referred to as "colorless" or "clear" where a colorant is not used), optionally a wax, and optionally a charge control agent. In embodiments, prior to performing the phase inversion, the toner composition already contains all of the toner ingredients (e.g., toner resin, wax, colorant, and charge control agent) with none to be added subsequent to the phase inversion. In other embodiments, prior to performing the phase inversion, the toner composition does not contain all of the toner ingredients; one or more toner ingredients (e.g., external charge control agent) can be added subsequent to the phase inversion in any suitable manner. In embodiments, prior to performing the phase inversion, "internal" toner ingredients (e.g., toner resin, colorant, wax, and internal charge control agent) are present in the toner composition and it is optional to include the "external" toner ingredients prior to performing the phase inversion. The terms "internal" and "external" refer to whether the toner ingredients are found throughout the resulting toner particles or just on the surface thereof. In embodiments, prior to performing the phase inversion, the ingredients of the toner composition are blended via for instance melt-mixing at any suitable temperature (e.g., about 60 to about 120 degrees C.), time (e.g., about 10 minutes to about 3 hours), and stirring speed (e.g., about 100 to about 800 rpm).

For the emulsion and phase inversed emulsion, the ingredient(s) of the toner composition is present in an amount by weight ranging for example from about 5% to about 35%, or from about 5% to about 20%, or from about 10% to about 20% of the emulsion/phase inversed emulsion.

Toners may be comprised of thermoplastic resins that typically exhibit flow properties such as a viscosity range of for example about 10 poise to about 10,000 poise at temperatures of from about 70° C. to about 180° C., thereby permitting the toner to wet or penetrate into a substrate such as paper upon which the toner is to be fixed in forming an image. The toner image, once melted and cooled onto the substrate, displays mechanical properties such as crease, as determined by creasing a section of the substrate such as paper with a toned image thereon and quantifying the degree to which the toner in the crease separates from the paper. A good crease resistance may be considered a value of less than 1 mm, where the average width of the creased image is measured by printing an image on paper, followed by (a) folding inwards the printed area of the image, (b) passing over the folded image a standard TEFLON (polytetrafluoroethylene) coated copper roll weighing about 860 grams, (c) unfolding the paper and wiping the loose ink from the creased imaged surface with a cotton swab, and (d) measuring the average width of the ink free creased area with an image analyzer. The crease value can also be reported in terms of area, especially when the image is sufficiently hard to break unevenly on creasing; measured in terms of area, crease values of 100 millimeters correspond to about 1 mm in width. Further, the images exhibit fracture coefficients, for example of greater than unity. From the image analysis of the creased area, it is possible to determine whether the image shows a small single crack line or is more brittle and easily cracked. A single crack line in the creased area provides a fracture coefficient of unity while a highly cracked crease exhibits a fracture coefficient of greater than unity. The greater the cracking, the greater the fracture coefficient. Toners exhibiting acceptable mechanical properties, which are suitable for office documents, may be obtained by utilizing the aforementioned thermoplastic resins. However, there is also a need for digital xerographic applications for flexible packaging on various substrates. For flexible packaging applications, the toner materials must meet very demanding requirements such as being able to withstand the high temperature conditions to which they are exposed in the packaging process and enabling hot pressure-resistance of the images. Other applications, such as books and manuals, require that the image does not document offset onto the adjacent image. These additional requirements require alternate resin systems, for example that provide thermoset properties such that a crosslinked resin results after fusing or post-fusing on the toner image.

A desirable toner resin, then, may have a thermoplastic property, such as low viscosity during fusing so as to permit the fusing to proceed at a temperature of, for example on the order of about 160° C. or less, for example from about 70° C. to about 150° C. or from about 80° C. to about 140° C., and then after or during the melting onto the image receiving substrate, should be transformable into a thermoset state such as a higher molecular weight by crosslinking of the resin. The resultant high molecular weight resin in the fused image exhibits the mechanical properties, such as fracture coefficient, crease resistance and packaging requirements such as hot pressure-resistance, and high document offset.

One, two, or more toner resins may be used. In embodiments where two or more toner resins are used, the toner resins may be in any suitable ratio (e.g., weight ratio) such as for instance about 10% (first resin)/90% (second resin) to about 90% (first resin)/10% (second resin). Illustrative examples of toner resins include branched styrene acrylates, styrene methacrylates, styrene butadienes, vinyl resins, including branched homopolymers and copolymers of two or more vinyl monomers; vinyl monomers include styrene, p-chlorostyrene, butadiene, isoprene, and myrcene; vinyl esters like esters of monocarboxylic acids including methyl acrylate, ethyl acrylate, n-butyl acrylate, isobutyl acrylate, dodecyl acrylate, n-octyl acrylate, phenyl acrylate, methyl methacrylate, ethyl methacrylate, and butyl methacrylate; acrylonitrile, methacrylonitrile, acrylamide; and the like. Representative toner resins include styrene butadiene copolymers, mixtures thereof, and the like. Other representative toner resins include styrene/n-butyl acrylate copolymers, PLIOLITES®; suspension polymerized styrene butadienes, reference U.S. Pat. No. 4,558,108, the disclosure of which is totally incorporated herein by reference.

An epoxy resin may be used. As the epoxy resin, any resin, for example any material having a weight average molecular weight of, for example, about 500 or more, such as 1,000 or more, and containing epoxy groups may be used. Epoxy resin herein refers to, for example, any molecule containing more than one epoxide (oxirane) group. As epoxy resins, use may be made of, for example, glycidyl epoxy resins, such as glycidyl epoxy ethers, glycidyl epoxy esters, glycidyl epoxy amines, and the like. In embodiments, the epoxy resin is an epoxy based upon bisphenol A, for example such as based upon a reaction product of bisphenol A and epichlorohydrin, such as including diglycidyl ethers of bisphenol A. Novolac epoxy resins, for example such as formed by the reaction of phenolic novolac resins with epichlorohydrin, may also be used. Suitable commercially available examples of epoxy resins include the D.E.R. epoxy resins from The Dow Chemical Company, including D.E.R. 664U that is described as a reaction product between liquid epoxy resin and bisphenol A.

The epoxy resin may have a glass transition temperature of about 40° C. or more, for example from about 40° C. to about 90° C., and preferably such as from about 50° C. to about 65° C. In addition, the epoxy resin may exhibit a viscosity at the phase inversion temperature (which may be from about 50° C. to about 120° C., for example from about 60° C. to about 105° C. or from about 70° C. to about 100° C.) of from about 10 poise to about 10,000 poise.

In embodiments, the toner composition includes as a toner resin a sulfonated polyester or a sulfopolyester. As the sulfonated polyester resin, mention may be made of, for example, an alkali metal sulfonated polyester resin such as a sodium and/or lithium sulfonated polyester resin.

In embodiments herein, sulfonated refers, for example, to a polyester resin containing a sulfur atom, such as a sulfo group, for example an —$SO_3$ group and the like. In embodiments, the sulfonated polyester resin may have the following general structure, or random copolymers thereof in which the m and n segments are separated:

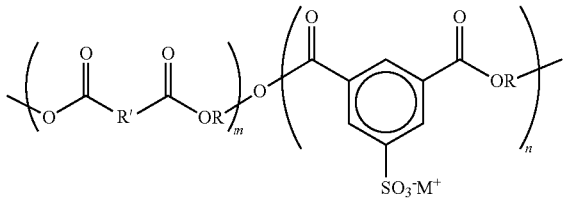

In the formula, R may be an alkylene of, for example, from about 2 to about 25 carbon atoms, such as from about 2 to about 20 carbon atoms or from about 2 to about 10 carbon atoms, such as ethylene, propylene, butylene, oxyalkylene diethyleneoxide and the like, R' may be an arylene of, for example, from about 6 to about 36 carbon atoms, such as from about 6 to about 20 carbon atoms or from about 6 to about 15 carbon atoms, such as a benzylene, bisphenylene, bis(alkyloxy) bisphenolene and the like, and the variables m and n may represent the number of randomly repeating segments, such as for example from about 10 to about 100,000, for example from about 100 to about 50,000 or from about 1,000 to about 50,000, and M may represent an alkali metal such as sodium, lithium, potassium, any combinations thereof, and the like.

In embodiments, R may be ethylene, propylene, dipropylene or a combination thereof, R' may be benzylene, bisphenylene or a combination thereof, and M may be lithium, sodium or a combination thereof. More specifically, R may be propylene and/or dipropylene, R' may be benzylene and M may be sodium.

In further embodiments, the sulfonated polyester may be branched (crosslinked) and/or linear.

The sulfopolyester selected may have a number average molecular weight (Mn) of from about 1,000 to about 500,000, for example from about 1,000 to about 250,000 or from about 5,000 to about 250,000, grams per mole and a weight average molecular weight (Mw) of from about 2,000 to about 600,000, for example from about 2,000 to about 300,000 or from about 10,000 to about 300,000, grams per mole as measured by gel permeation chromatography (GPC) and using polystyrene standards. The onset glass transition temperature (Tg) of the resin as measured by a differential scanning calorimeter (DSC) is, in embodiments, for example, from about 50° C. to about 90° C., and more specifically from about 50° C. to about 70° C.

Examples of sulfonated polyester resins include copoly(ethylene-terephthalate)-copoly-(ethylene-5-sulfo-isophthalate), copoly(propylene-terephthalate)-copoly(propylene-5-sulfo-isophthalate), copoly(diethylene-terephthalate)-copoly(diethylene-5-sulfo-isophthalate), copoly(propylene-diethylene-terephthalate)-copoly(propylene-diethylene-5-sulfo-isophthalate), copoly(5-sulfo-isophthalate-1,3-propylene/dipropylene)-copoly(1,3-propylene/dipropylene-terephthalate), copoly(propylene-butylene-terephthalate)-copoly(propylene-butylene-5-sulfo-isophthalate), copoly(propoxylated bisphenol-A-fumarate)-copoly(propoxylated bisphenol A-5-sulfo-isophthalate), copoly(ethoxylated bisphenol-A-fumarate)-copoly(ethoxylated bisphenol-A-5-sulfo-isophthalate), copoly(ethoxylated bisphenol-A-maleate)-copoly(ethoxylated bisphenol-A-5-sulfo-isophthalate), copoly(5-sulfoisophthaloyl)-co-poly(ethylene-adipate), alkali copoly(5-sulfoisophthaloyl)-copoly(propylene-adipate), copoly(5-sulfoisophthaloyl)-copoly(butylene-adipate), copoly(5-sulfo-isophthaloyl)-copoly(pentylene-adipate), copoly(5-sulfo-iosphthaloyl)-copoly(octylene-adipate), copoly(5-sulfo-isophthaloyl)-copoly(ethylene-adipate), copoly(5-sulfo-isophthaloyl)-copoly (propylene-adipate), copoly(5-sulfo-isophthaloyl)-co-poly(butylene-adipate), copoly(5-sulfo-isophthaloyl)-copoly(pentylene-adipate), copoly(5-sulfo-isophthaloyl)-copoly(hexylene-adipate), copoly(5-sulfo-isophthaloyl)-copoly(octylene-adipate), copoly(5-sulfoisophthaloyl)-copoly(ethylene-succinate), copoly(5-sulfoisophthaloyl-copoly(butylene-succinate), copoly(5-sulfoisophthaloyl)-copoly(hexylene-succinate), copoly(5-sulfoisophthaloyl)-copoly(octylene-succinate), copoly(5-sulfo-isophthaloyl)-copoly(ethylene-sebacate), copoly(5-sulfo-isophthaloyl)-copoly(propylene-sebacate), copoly(5-sulfo-isophthaloyl)-copoly(butylene-sebacate), copoly(5-sulfo-isophthaloyl)-copoly(pentylene-sebacate), copoly(5-sulfo-isophthaloyl)-copoly(hexylene-sebacate), copoly(5-sulfo-isophthaloyl)-copoly(octylene-sebacate), copoly(5-sulfo-isophthaloyl)-copoly(ethylene-adipate), copoly(5-sulfo-isophthaloyl)-copoly(propylene-adipate), copoly(5-sulfo-iosphthaloyl)-copoly(butylene-adipate), copoly(5-sulfo-isophthaloyl)-copoly(pentylene-adipate), copoly(5-sulfo-isophthaloyl)copoly(hexylene-adipate) and the like. The alkali metal forms of the sulfonated polyesters may have the alkali metal as, for example, a sodium, lithium and/or potassium ion.

The sulfonated polyester resin may exhibit a sulfonation percentage of from about 5% to about 15%, such as from about 5% to about 10% or from about 6% to about 10%, of the resin. Sulfonation percentage refers to, for example, the amount of sulfo groups present, on a weight percentage basis, of the resin. The sulfonation is believed to assist in stabilizing the epoxy resin in the emulsion/phase inversed emulsion.

In embodiments, the toner composition comprises an epoxy resin and optionally a sulfonated polyester resin. Further, while chemical reaction between the epoxy resin and the sulfonated polyester resin is not precluded herein, neither is such required.

In embodiments, the emulsion/phase inversed emulsion may optionally include one, two, or more surfactants. The surfactants may be selected from ionic surfactants and nonionic surfactants. Anionic surfactants and cationic surfactants are encompassed by the term "ionic surfactants." In embodiments, the surfactant is present in an amount of from about 0.5% to about 10% by weight of the emulsion/phase inversed emulsion, for example from about 1% to about 8% or from about 0.5% to about 5% by weight of the emulsion/phase inversed emulsion. Molecules of the surfactant are typically found at the interface between the disperse phase and the continuous phase for the emulsion/phase inversed emulsion but surfactant molecules also can be present in the disperse phase and/or continuous phase as well.

Examples of nonionic surfactants that can be selected for the processes illustrated herein and that may be included in the emulsion are, for example, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, available from Rhone-Poulenac as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™. Representative surfactants are found for instance in a publication from Uniqema titled "Resin emulsification for waterborne coatings and adhesives", pp. 1-14 (unknown when first made available on the web but available on Dec. 7, 2005), the disclosure of which is totally incorporated herein by reference, available on the website "www.uniqema.com/pr/lit/resinemulsification.pdf."

A particular example of a suitable nonionic surfactant for use herein is, for example, a block copolymer of polyethylene oxide and polypropylene oxide, for example commercially available as SYNPERONIC PE/F such as including SYNPERONIC PE/F 108.

Examples of anionic surfactants include, for example, sodium dodecylsulfate (SDS), sodium dodecylbenzene sulfonate, sodium dodecylnaphthalene sulfate, dialkyl benzenealkyl, sulfates and sulfonates, abitic acid, available from Aldrich, NEOGEN RK™, NEOGEN SC™ from Kao and the like.

Examples of the cationic surfactants, which are usually positively charged, include, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™, available from Alkaril Chemical Company, SANIZOL™ (benzalkonium chloride), available from Kao Chemicals, and the like, and mixtures thereof.

In embodiments, the emulsion/phase inversed emulsion may also have included therein a hardener or catalyst for crosslinking of the toner resin. The catalyst may be a thermal crosslinking catalyst, for example a catalyst that initiates crosslinking at temperatures of, for example, about 160° C. or less such as about 50° C. to about 160° C. or from about 100° C. to about 160° C. Examples of suitable crosslinking catalysts (to crosslink for instance an epoxy resin) include, for example, blocked acid catalysts such as available from King Industries under the name NACURE, for example including NACURE SUPER XC-7231 and NACURE XC-AD230. Other known catalysts to initiate crosslinking may also be used, for example including catalysts such as aliphatic amines and alicyclic amines, for example bis(4-aminocyclohexyl) methane, bis(aminomethyl)cyclohexane, m-xylenediamine, and 3,9-bis(3-aminopropyl)-2,4,8, 10-tetraspiro[5,5]undecane; aromatic amines, for example metaphenylene diamine, diaminodiphenylmethane, and diaminodiphenyl sulfone; tertiary amines and corresponding salts, for example benzyldimethylamine, 2,4,6-tris(dimethylaminomethyl)phenol, 1,8-diazabicyclo(5,4,0)undecene-7,1,5-diazabicyclo(4,3,0) nonene-7; aromatic acid anhydrides, for example phthalic anhydride, trimellitic anhydride, and pyromellitic anhydride; alicyclic carboxylic anhydrides, for example tetrahydrophthalic anhydride, methyltetrahydrophthalic anhydride, hexahydrophthalic anhydride, methylhexahydrophthalic anhydride, methylendomethylenetetrahydrophthalic anhydride, dodecenylsuccinic anhydride, and trialkyltetrahydrophthalic anhydrides; polyvalent phenols, for example catechol, resorcinol, hydroquinone, bisphenol F, bisphenol A, bisphenol S, biphenol, phenol novolac compounds, cresol novolac compounds, novolac compounds of divalent phenols such as bisphenol A, trishydroxyphenylmethane, aralkylpolyphenols, and dicyclopentadiene polyphenols; imidazoles and salts thereof, for example 2-methylimidazole, 2-ethyl-4-methylimidazole, and 2-phenylimidazole; $BF_3$ complexes of amine; Bronsted acids, for example aliphatic sulfonium salts and aromatic sulfonium salts; dicyandiamide; organic acid hydrazides, for example adipic acid dihydrazide and phthalic acid dihydrazide; resols; polycarboxylic acids, for example adipic acid, sebacic acid, terephthalic acid, trimellitic acid, polyester resins containing carboxylic groups; organic phosphines; combinations thereof and the like. The catalyst may be included in an amount of from, for example, about 0.1% to about 20% by weight of the emulsion/phase inversed emulsion, such as from about 0.5% to about 10% or from about 1% to about 10% by weight of the emulsion/phase inversed emulsion.

If a catalyst is used, the catalyst may be incorporated into the toner composition by for instance melt mixing prior to the phase inversion. In other embodiments, the catalyst may be added to the toner composition subsequent to the phase inversion.

In embodiments, the emulsion and phase inversed emulsion have good storage stability, for example being able to remain substantially stable over time at room temperature conditions.

As the colorant to be added, various known suitable colorants, such as dyes, pigments, mixtures of dyes, mixtures of pigments, mixtures of dyes and pigments, and the like, may be included in the toner. The colorant may be included in the toner in an amount of, for example, about 0.1 to about 35 percent by weight of the toner, or from about 1 to about 15 weight percent of the toner, or from about 3 to about 10 percent by weight of the toner.

As examples of suitable colorants, mention may be made of carbon black like REGAL 330®; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue or mixtures thereof. Generally, cyan, magenta, or yellow pigments or dyes, or mixtures thereof, are used. The pigment or pigments are generally used as water based pigment dispersions.

Specific examples of pigments include SUNSPERSE 6000, FLEXIVERSE and AQUATONE water based pigment dispersions from SUN Chemicals, HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Generally, colorants that can be selected are black, cyan, magenta, or yellow, and mixtures thereof. Examples of magentas are 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans include copper tetra(octadecyl sulfonamido) phthalocyanine, x-copper phthalocyanine pigment listed in the Color Index as CI 74160, CI Pigment Blue, and Anthrathrene Blue, identified in the Color Index as CI 69810, Special Blue X-2137, and the like. Illustrative examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as colorants. Other known colorants can be selected, such as Levanyl Black A-SF (Miles, Bayer) and Sunsperse Carbon Black LHD 9303 (Sun Chemicals), and colored dyes such as Neopen Blue (BASF), Sudan Blue OS (BASF), PV Fast Blue B2G01 (American Hoechst), Sunsperse Blue BHD 6000 (Sun Chemicals), Irgalite Blue BCA (Ciba-Geigy), Paliogen Blue 6470 (BASF), Sudan III (Matheson, Coleman, Bell), Sudan II (Matheson, Coleman, Bell), Sudan IV (Matheson, Coleman, Bell), Sudan Orange G (Aldrich), Sudan Orange 220 (BASF), Paliogen Orange 3040 (BASF), Ortho Orange OR 2673 (Paul Uhlich), Paliogen Yellow 152, 1560 (BASF), Lithol Fast Yellow 0991K (BASF), Paliotol Yellow 1840 (BASF), Neopen Yellow (BASF), Novoperm Yellow FG 1 (Hoechst), Permanent Yellow YE 0305 (Paul Uhlich), Lumogen Yellow D0790 (BASF), Sunsperse Yellow YHD 6001 (Sun Chemicals), Suco-Gelb L1250 (BASF), Suco-Yellow D1355 (BASF), Hostaperm Pink E (American Hoechst), Fanal Pink D4830 (BASF), Cinquasia Magenta (DuPont), Lithol Scarlet D3700 (BASF), Toluidine Red (Aldrich), Scarlet for Thermoplast NSD PS PA (Ugine Kuhlmann of Canada), E.D. Toluidine Red (Aldrich), Lithol Rubine Toner (Paul Uhlich), Lithol Scarlet 4440 (BASF), Bon Red C (Dominion Color Company), Royal Brilliant Red RD-8192 (Paul Uhlich), Oracet Pink RF (Ciba-Geigy), Paliogen Red 3871K (BASF), Paliogen Red 3340 (BASF), and Lithol Fast Scarlet L4300 (BASF).

Optionally, a wax may also be included in the toner composition. When included, the wax may be present in an amount of from, for example, about 1 weight percent to about 25 weight percent, or from about 5 weight percent to about 20 weight percent, of the toner particles.

Waxes that may be selected include waxes with, for example, a weight average molecular weight of from about 500 to about 20,000, in embodiments from about 500 to about 10,000. Waxes that may be used include, for example, polyolefins such as polyethylene, polypropylene, and polybutene waxes such as commercially available from Allied Chemical and Petrolite Corporation, for example POLYWAX™ polyethylene waxes from Baker Petrolite, wax emulsions available from Michaelman, Inc. and the Daniels Products Company, EPOLENE N-15™ commercially available from Eastman Chemical Products, Inc., and VISCOL 550-P™, a low weight average molecular weight polypropylene available from Sanyo Kasei K. K.; plant-based waxes, such as carnauba wax, rice wax, candelilla wax, sumacs wax, and jojoba oil; animal-based waxes, such as beeswax; mineral-based waxes and petroleum-based waxes, such as montan wax, ozokerite, ceresin, paraffin wax, microcrystalline wax, and Fischer-Tropsch wax; ester waxes obtained from higher fatty acid and higher alcohol, such as stearyl stearate and behenyl behenate; ester waxes obtained from higher fatty acid and monovalent or multivalent lower alcohol, such as butyl stearate, propyl oleate, glyceride monostearate, glyceride distearate, and pentaerythritol tetra behenate; ester waxes obtained from higher fatty acid and multivalent alcohol multimers, such as diethyleneglycol monostearate, dipropyleneglycol distearate, diglyceryl distearate, and triglyceryl tetrastearate; sorbitan higher fatty acid ester waxes, such as sorbitan monostearate, and cholesterol higher fatty acid ester waxes, such as cholesteryl stearate. Examples of functionalized waxes that may be used include, for example, amines, amides, for example AQUA SUPERSLIP 6550™, SUPERSLIP 6530™ available from Micro Powder Inc., fluorinated waxes, for example POLYFLUO 190™, POLYFLUO 200™, POLYSILK 19™, POLYSILK 14™ available from Micro Powder Inc., mixed fluorinated, amide waxes, for example MICROSPERSION 19™ also available from Micro Powder Inc., imides, esters, quaternary amines, carboxylic acids or acrylic polymer emulsion, for example JONCRYL 74™, 89™, 130™, 537™, and 538™, all available from SC Johnson Wax, and chlorinated polypropylenes and polyethylenes available from Allied Chemical and Petrolite Corporation and SC Johnson wax. Mixtures of waxes may also be used. Waxes may be included as, for example, fuser roll release agents.

The toner particles are optionally washed with water to remove for instance the surfactant, and then dried. Drying may be accomplished by any suitable method for drying, including for example freeze-drying.

The toner particles in embodiments may also contain other optional additives, as desired or required. For example, the toner may include positive or negative charge control agents, for example in an amount of about 0.1 to about 10, such as about 1 to about 3, percent by weight of the toner. Examples of these charge control agents include quaternary ammonium compounds inclusive of alkyl pyridinium halides; bisulfates; alkyl pyridinium compounds, reference U.S. Pat. No. 4,298,672, the disclosure of which is totally incorporated hereby by reference; organic sulfate and sulfonate compositions, reference U.S. Pat. No. 4,338,390, the disclosure of which is totally incorporated hereby by reference; cetyl pyridinium tetrafluoroborates; distearyl dimethyl ammonium methyl sulfate; aluminum salts such as BONTRON E84™ or E88™ (Hodogaya Chemical); mixtures thereof and the like.

There can also be blended with the toner particles external additive particles including flow aid additives, which additives may be present on the surface of the toner particles. Examples of these additives include metal oxides such as titanium oxide, silicon oxide, tin oxide, mixtures thereof, and the like; colloidal silicas, such as AEROSIL®, metal salts and metal salts of fatty acids inclusive of zinc stearate, aluminum oxides, cerium oxides, and mixtures thereof. Each of the external additives may be present in an amount of from about 0.1 percent by weight to about 5 percent by weight, and more specifically, in an amount of from about 0.1 percent by weight to about 1 percent by weight, of the toner. Several of the aforementioned additives are illustrated in U.S. Pat. Nos. 3,590,000 and 6,214,507, the disclosures of which are totally incorporated herein by reference.

In embodiments, the dry toner particles, exclusive of external surface additives, may have the following characteristics:

(1) Volume average diameter (also referred to as "volume average particle diameter"), for example, about 3 to about 25 μm, from about 3 to about 12 μm or about 5 to about 10 μm.

(2) Number Average Geometric Size Distribution (GSDn) and/or Volume Average Geometric Size Distribution (GSDv), for example, about 1.05 to about 1.45, such as about 1.10 to about 1.40.

(3) Circularity, for example, about 0.950 to 1.000 (measured with for instance an FPIA 2100 analyzer from Sysmex).

In embodiments, the above toner particle characteristics are determined subsequent to the solidifying the toner-sized droplets to result in the toner particles and after any optional processing (e.g., filtering).

The characteristics of the toner particles may be determined by any suitable technique and apparatus. However, if there is a material variance in measurement values between different techniques/apparatus, the techniques/apparatus described herein are preferred. Volume average particle diameter D.sub.50v, GSDv, and GSDn are measured by means of a measuring instrument such as a Multisizer 3 available from Beckman Coulter. Representative sampling is now described: take a small amount of toner sample (about 1 g), filter through 25 micrometer screen, then put in isotone solution to obtain a concentration about 10%, and run sample in for example a Multisizer 3 Coulter counter available from Beckman Coulter.

The toner particles may be formulated into a developer composition. The toner particles may be mixed with carrier particles to achieve a two-component developer composition. The toner concentration in the developer may range from, for example, about 1% to about 25%, such as about 2% to about 15%, by weight of the total weight of the developer.

Examples of carrier particles that can be selected for mixing with the toner include those particles that are capable of triboelectrically obtaining a charge of opposite polarity to that of the toner particles. Illustrative examples of suitable carrier particles include granular zircon, granular silicon, glass, steel, nickel, ferrites, iron ferrites, silicon dioxide, and the like. Additionally, there can be selected as carrier particles nickel berry carriers as disclosed in U.S. Pat. No. 3,847,604, comprised of nodular carrier beads of nickel, characterized by surfaces of reoccurring recesses and protrusions thereby providing particles with a relatively large external area. Other carriers are disclosed in U.S. Pat. Nos. 4,937,166 and 4,935,326.

The selected carrier particles can be used with or without a coating. In one embodiment, the carrier particles are comprised of a core with coating thereover generated from a mixture of polymers that are not in close proximity thereto in the triboelectric series. The coating may be comprised of fluoropolymers, such as polyvinylidene fluoride resins, terpolymers of styrene, methyl methacrylate, and a silane, such as triethoxy silane, tetrafluoroethylenes, other known coatings and the like. For example, coating containing polyvinylidenefluoride, available, for example, as KYNAR 301F™, and/or polymethylme thacrylate, for example having a weight average molecular weight of about 300,000 to about 350,000, such as commercially available from Soken, may be used. In embodiments, polyvinylidenefluoride and polymethylmethacrylate may be mixed in proportions of from about 30 to about 70 wt. % to about 70 to about 30 wt. %, in embodiments from about 40 to about 60 wt. % to about 60 to about 40 wt. %. The coating may have a coating weight of from, for example, about 0.1 to about 5% by weight of the carrier, such as about 0.5 to about 2% by weight. The PMMA may optionally be copolymerized with any desired comonomer, so long as the resulting copolymer retains a suitable particle size. Suitable comonomers can include monoalkyl, or dialkyl amines, such as a dimethylaminoethyl methacrylate, diethylaminoethyl methacrylate, diisopropylaminoethyl methacrylate, or t-butylaminoethyl methacrylate, and the like. The carrier particles may be prepared by mixing the carrier core with from, for example, about 0.05 to about 10 percent by weight, such as about 0.05 percent and about 3 percent by weight, based on the weight of the coated carrier particles, of polymer until adherence thereof to the carrier core by mechanical impaction and/or electrostatic attraction. Various effective suitable means can be used to apply the polymer to the surface of the carrier core particles, for example, cascade roll mixing, tumbling, milling, shaking, electrostatic powder cloud spraying, fluidized bed, electrostatic disc processing, and with an electrostatic curtain. The mixture of carrier core particles and polymer is then heated to enable the polymer to melt and fuse to the carrier core particles. The coated carrier particles are then cooled and thereafter classified to a desired particle size.

An exemplary suitable carrier is a steel core, for example of about 25 to about 100 μm in size, in embodiments from about 50 to about 75 μm in size, coated with about 0.5% to about 10% by weight, in embodiments from about 0.7% to about 5% by weight, such as about 1% by weight, of a conductive polymer mixture comprised of, for example, methylacrylate and carbon black using the process described in U.S. Pat. Nos. 5,236,629 and 5,330,874.

The carrier particles can be mixed with the toner particles in various suitable combinations. The concentrations are usually about 1% to about 20% by weight of toner and about 80% to about 99% by weight of carrier. However, different toner and carrier percentages may be used to achieve a developer composition with desired characteristics.

The toners can be selected for electrostatographic or xerographic process, reference for example, U.S. Pat. No. 4,295,990, incorporated herein by reference in its entirety. In embodiments, any known type of image development system may be used in an image developing device, including, for example, magnetic brush development, jumping single-component development, hybrid scavengeless development (HSD), etc. These development systems are known in the art.

Imaging processes comprise, for example, preparing an image with a xerographic device comprising a charging component, an imaging component, a photoconductive component, a developing component, a transfer component, and a fusing component; and wherein the development component comprises a developer prepared by mixing a carrier with a toner composition illustrated herein. The xerographic device may comprise a high speed printer, a black and white high speed printer, a color printer, and the like.

Once the image is formed with toners/developers via a suitable image development method such as any one of the aforementioned methods, the image is then transferred to an image receiving medium such as paper and the like. In embodiments, the toners may be used in developing an image in an image-developing device utilizing a fuser roll member. Fuser roll members are contact fusing devices that are known in the art, in which heat and pressure from the roll are used in order to fuse the toner to the image-receiving medium. Typically, the fuser member may be heated to a temperature above the fusing temperature of the toner, for example to temperatures of from about 70° C. to about 160° C., for example from about 70° C. to about 150° C. or from about 80° C. to about 140° C., and then after or during the melting onto the image receiving substrate.

In embodiments where the toner resin is crosslinkable, such crosslinking may be accomplished in any suitable manner. For example, the toner resin may be crosslinked during fusing of the toner to the substrate where the toner resin is crosslinkable at the fusing temperature. Crosslinking also may be effected by heating the fused image to a temperature at which the toner resin will be crosslinked, for example in a post-fusing operation. In embodiments, crosslinking may be effected at temperatures of from about 160° C. or less, for example from about 70° C. to about 160° C. or from about 80° C. to about 140° C.

The images that include the crosslinked toner resin exhibit excellent crease resistance, for example of about 1 mm or less, and excellent fracture coefficient, for example of about unity or less.

The invention will now be described in detail with respect to specific exemplary embodiments thereof, it being understood that these examples are intended to be illustrative only and the invention is not intended to be limited to the materials, conditions, or process parameters recited herein. All percentages and parts are by weight unless otherwise indicated. As used herein, "room temperature" refers to a temperature ranging from about 20 to about 25 degrees C.

EXAMPLE

A 2 Liter reactor from Buchi was charged with 500 grams of Dow Epoxy DER 664U, 125 grams of 5% sulfonated polyester resin (copoly(propylene -diethylene-terephthalate)-copoly(propylene-diethylene-5-sulfo-isophthalate)) and 37.5 grams of non-ionic solid surfactant, SANSPARL™ ST-36 from Sanyo Chemical Industries. The mixture was heated to 90 degrees C. for 3 hours at 200 rpm. Stirring was then increased to 600 rpm for 30 min. The maximum temperature reached 107° C. About 300 g of deionized water was pumped in slowly (pump by Fluid Metering Incorporated Model QG20) at a rate of about 5 g/min. Then there was added all at one time 300 g more water to above emulsion. The mixture was then cooled to room temperature and discharged from the reactor. The surfactant was washed off (washed three to five times with water and filtration using 25 micrometer mesh size metal screen). The toner particles were then subjected to a freeze drier. There resulted a crosslinkable clear toner with the following characteristics: an volume average particle diameter of about 5.83 micrometer, GSDv of about 1.38, and circularity of about 0.975.

The resulting crosslinkable clear toner exhibited satisfactory fusing characteristics with respect to for example document offset performance, fusing temperature, fusing time, and crosslinking time.

The invention claimed is:

1. A process for making toner particles comprising:

providing a toner composition comprising a toner resin, a wax, and a charge control agent, the toner resin comprising an epoxy resin and a sulfonated polyester resin;

heating the toner composition to a temperature of from about 50° C. to about 120° C. to form a molten toner composition;

adding a first aqueous composition to the molten toner composition to form an emulsion comprising a disperse phase and a continuous phase, the disperse phase including the first aqueous composition and the continuous phase including the molten toner composition, wherein there is absent organic toner resin solvent in the continuous phase;

performing a phase inversion to create a phase inversed emulsion comprising a disperse phase including toner-sized droplets comprising the molten toner composition and a continuous phase including a second aqueous composition; and solidifying the toner-sized droplets to result in toner particles;

wherein the phase inversed emulsion further comprises a surfactant; and wherein the first aqueous composition comprises water and a liquid, wherein the liquid is polar, does not dissolve the toner resin, and is miscible with water.

2. The process of claim 1, wherein the toner composition is clear.

3. The process of claim 1, wherein the toner resin is crosslinkable.

4. The process of claim 1, wherein the molten toner composition has a viscosity ranging from about 10 to about 10,000 poises.

5. A process for making toner particles comprising:

heating a toner composition to a temperature of from about 50° C. to about 120° C. to form a molten toner composition, wherein the molten toner composition comprises a toner resin, a wax, and a charge control agent, and wherein a toner resin solvent is absent from the molten toner composition, and the toner resin comprises an epoxy resin and a sulfonated polyester resin;

adding an aqueous composition to the molten toner composition to create a phase inversed emulsion comprising a disperse phase and a continuous phase, the disperse phase including toner-sized droplets comprising the molten toner composition and the continuous phase including the aqueous composition; and solidifying the toner-sized droplets to result in toner particles wherein the phase inversed emulsion further comprises a surfactant; and wherein the aqueous composition comprises water and a liquid, wherein the liquid is polar, does not dissolve the toner resin, and is miscible with water.

6. The process of claim 5, wherein the toner composition is clear.

7. The process of claim 5, wherein the toner resin is crosslinkable.

8. The process of claim 5, wherein the heating results in the molten toner composition having a viscosity ranging from about 10 to about 10,000 poises.

9. A process for making toner particles comprising:

heating a toner composition to a temperature of from about 50° C. to about 120° C. to form a molten toner composition, wherein the molten toner composition comprises a toner resin, a wax, a surfactant, and a charge control agent, and wherein a toner resin solvent is absent from the molten toner composition, and the toner resin comprises an epoxy resin and a sulfonated polyester resin;

adding an aqueous composition to the molten toner composition to create a phase inversed emulsion comprising a disperse phase and a continuous phase, the disperse phase including toner-sized droplets comprising the molten toner composition and the continuous phase including the aqueous composition;

solidifying the toner-sized droplets to result in toner particles; and stirring at a rate ranging from about 50 to about 200 rpm during the heating to the molten state, and stirring at a rate ranging from about 600 to about 1,000 rpm during the adding the aqueous composition to the molten toner composition.

10. The process of claim 1, wherein the liquid is ethanol, isopropanol, or acetic acid.

* * * * *